United States Patent [19]

Drummond

[11] 4,033,741

[45] July 5, 1977

[54] METHOD AND APPARATUS FOR FORMING CONTAINERIZED GLASS STRAND PACKAGE

[75] Inventor: Warren W. Drummond, Allison Park, Pa.

[73] Assignee: PPG Industries, Inc., Pittsburgh, Pa.

[22] Filed: Jan. 19, 1976

[21] Appl. No.: 650,329

[52] U.S. Cl. ..... 65/2; 28/290; 65/11 W; 226/170; 242/18 G

[51] Int. Cl.² ..... C03B 37/02

[58] Field of Search ..... 65/2, 11 W, 11 R, 9, 65/4 R; 242/18 G; 28/21, 72 SP; 226/170

[56] References Cited

UNITED STATES PATENTS

| | | | |
|---|---|---|---|
| 2,719,350 | 10/1955 | Slayter et al. | 28/1 |
| 2,719,351 | 10/1955 | Drummond | 28/21 |
| 2,719,352 | 10/1955 | Slayter et al. | 28/72 |
| 2,729,030 | 1/1956 | Slayter | 65/11 W X |
| 2,736,512 | 2/1956 | Drummond et al. | 242/159 |
| 2,736,676 | 2/1956 | Frickert | 65/9 X |
| 2,746,118 | 5/1956 | Drummond et al. | 28/21 |
| 2,834,092 | 5/1958 | Drummond et al. | 28/72 |
| 2,863,208 | 12/1958 | Drummond et al. | 28/72 |
| 3,120,689 | 2/1964 | Drummond | 28/1 |
| 3,293,013 | 12/1966 | Drummond | 65/11 W X |
| 3,295,942 | 1/1967 | Smock et al. | 65/2 |
| 3,318,746 | 5/1967 | Langlois | 156/167 |
| 3,393,985 | 7/1968 | Langlois et al. | 65/9 |
| 3,430,312 | 3/1969 | Drummond | 28/1 |
| 3,511,625 | 5/1970 | Pitt | 65/4 R |
| 3,887,347 | 6/1975 | Reese | 65/2 X |

*Primary Examiner*—Robert L. Lindsay, Jr.
*Attorney, Agent, or Firm*—Alan T. McDonald; John E. Curley

[57] ABSTRACT

A novel method and apparatus for forming a containerized package of glass fiber strand is disclosed. The method comprises impinging attenuated glass fiber strand onto a rotating surface, swirling the glass strand due to its inertial forces upon impingement with the surface, and collecting the swirled glass strand to form a containerized package of glass strand. Apparatus for accomplishing the attenuation and swirling operations is also disclosed.

13 Claims, 1 Drawing Figure

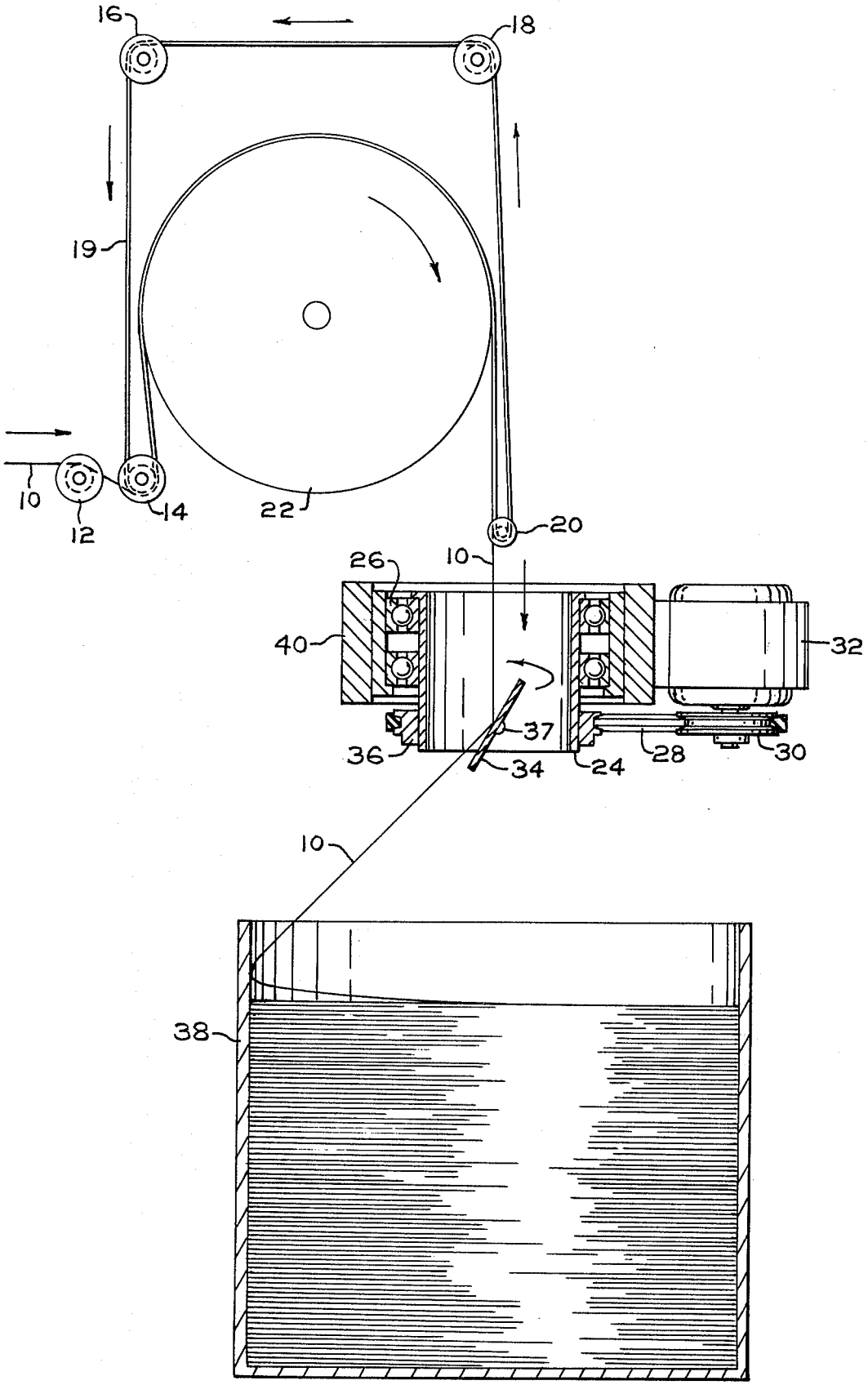
16
18
19
10
12
14
22
20
26
10
40
32
37
36
34
24
28
30
10
38

METHOD AND APPARATUS FOR FORMING CONTAINERIZED GLASS STRAND PACKAGE

BACKGROUND OF THE INVENTION

Glass filaments are typically attenuated from molten glass through bushing tips in a bushing, coated with a lubricant binder and/or size, consolidated into a unified strand, and wound around a mandrel to produce a forming package of glass fiber strand. These packages are limited in size and do not normally exceed about 110 pounds (49.9 kilograms). An average size forming package ranges from about 20 to about 30 pounds (9.1 to 13.6 kilograms).

In an effort to produce packages of strand having greater weight, containerized packages of strand sometimes replace the forming packages previously mentioned. Typical of these packages are those shown in U.S. Pat. Nos. 2,719,350; 2,719,351; 2,719,352; 2,736,512; 2,746,118; 2,834,092; 2,863,208; 2,736,676; 3,295,942; 3,318,746; and 3,887,347. Of particular interest are U.S. Pats. No. 3,120,689; 3,430,312; and 3,887,347.

In U.S. Pat. No. 3,120,689 and 3,430,312 a containerized package is formed of a plurality of swirls of glass strand. However, unlike the present invention, the strands in these patents are wound around a sphere and are continuously doffed from the sphere.

In U.S. Pat. No. 3,887,347 glass strand is impinged upon a surface to relieve inertial forces after attenuation between a pair of toothed belts. This surface does not rotate and thus does not form the swirled strand as in the present invention.

It is desirable to form packages of swirled glass strand without the necessity of winding the strand prior to packaging.

THE PRESENT INVENTION

In accordance with the present invention, a containerized package of glass fiber strand is formed by taking advantage of the inertial forces present in the attenuated glass strand. The method comprises impinging the attenuated strand upon a rotating surface which is angled from the axis of the glass strand. The combination of the impingement of the glass strand on the rotating surface and the rotation of the surface itself swirls the glass strand forming a plurality of coils. These coils can be directly collected in a container for shipment to the customer. The container may be stationary and collect a plurality of coils so as to vertically stack the coils or, if the container is larger than the coils, the container may be rotated as it collects the coils to form a larger package. The containerized package formed in this manner can be made considerably larger than the forming packages normally produced on present commercial winders. These packages may contain, for example, up to about 400 pounds (181.5 kilograms) of glass strand, or even more.

BRIEF DESCRIPTION OF THE DRAWING

The FIGURE in the accompanying drawing diagrammatically illustrates the attenuation and collection of glass fiber strand in a container according to the method and apparatus of the present invention.

DETAILED DESCRIPTION OF THE DRAWING

In the FIGURE shown in the drawing, glass strand 10 has been previously formed by attenuating glass filaments through bushing tips in a bushing. The filaments have been coated with a lubricant binder and/or size and were gathered into a unified strand by a gathering shoe or roller prior to their arrival at the apparatus illustrated by means well-known in the glass fiber art. The strand 10 passes over guide 12 and around pulley 14 along with endless belt 19. The strand 10 is pulled between the belt 19 and a driven wheel 22, whose driving means are not shown. While the FIGURE illustrates a single strand 10 being attenuated, the apparatus may also attenuate several strands from one or more bushings at the same time, combining them into a roving having a plurality of strands at the guide 12. The strand 10 is pulled around wheel 22 with the belt 19 and follows the path of belt 19 until the strand 10 reaches the pulley 20. As the belt 19 abruptly turns around the pulley 20, the strand 10 is ejected in a straight line. As this occurs, the belt 19 passes around pulleys 18 and 16 in a continual loop. In addition to pulling the strand 10 along its path, the belt 19 and wheel 22 provide the attenuation forces necessary for the attenuation of the glass filaments associated with the strand 10. The release of a glass strand 10 from a belt by abruptly changing the direction of the belt is more fully explained in U.S. Pat. No. 3,293,013, which is incorporated herein by reference.

The glass strand 10, which is moving at speeds of about 1,000 to 9,000 feet per minute (304.8 to 2,743.2 meters per minute) or more, impinges upon a deflector surface 34 as does the ambient air pulled downwardly with the strand as it moves at these speeds. The surface 34 is located at an angle of about 30 to 45° from the straight trajectory of the strand 10. The surface 34 is formed of such material as fine wire mesh screen. This material has two advantages. First, there is little or no tendency for the wet strand 10 to stick to the surface 34. Additionally, and most importantly, the air is passed through the surface 34 as the strand 10 impinges upon the surface 34 moving downwardly with the strand. This is necessary to prevent the strand 10 from becoming partially filamentized or fluffed. This effect was noticed and used to advantage in U.S. Pat. No. 2,736,676 wherein glass strand was impinged upon a solid oscillating surface and the resulting strand was collected and sprayed with a binder to produce a glass fiber mat. However, such a fluffed strand would be unsatisfactory for purposes of the present invention.

The surface 34 is connected to a rotating chamber 24 by means such as a rod 37. The entire chamber 24 rotates about the axis of the strand 10. This is preferably accomplished by a belt drive, however, other rotating means could also be employed. Pulley 36 engages the exterior wall of chamber 24. A belt 28 rides in the pulley 36 and the pulley 30, the latter being driven by motor 32. This causes the chamber 24 and the deflector surface 34 to rotate around the axis of the strand 10. The chamber 24 rotates inside of bearing 26. The chamber 24 and the bearing 26 are located within a housing 40.

The vertical inertial forces of the strand 10 combined with the rotational forces of the deflector 34 cause the strand 10 to form swirls or coils below the deflector. A collector 38 is located below the deflector 34 and collects the coils or swirls of strand 10 as they pass downwardly from the deflector 34. Optionally, the collector 38 may be larger than the collected swirls of strand 10 and may itself be rotating. When such a collector is employed, the resulting package of coiled or swirled glass strand resembles a doughnut as in U.S. Pat. No. 3,120,689.

Variations in the size of the coils or swirls can be readily made. The size of the coil or swirl is inversely proportional to the rotational speed of the deflector. Thus, increases in the deflector rotational speed decreases the diameter and circumference of the coil or swirl. In addition, the size of the coil or swirl is directly proportional to the speed of the glass strand 10. Thus, an increase of the speed of the strand 10 increases the diameter and circumference of the coil or swirl formed. Strand coils having diameters from about 3.0 inches (7.62 centi-meters) to about 60.0 inches (152.4 centimeters) may be formed in this manner. It has been found particularly desirable to collect the strand having swirled, or coiled diameters of from about 3.0 to about 5.0 inches (7.62 to 12.70 centimeters).

While the attenuating and coiling apparatus has been described with reference to its preferred embodiment of packaging wet glass strand 10 as it is formed from a bushing and coated, the apparatus may be used to package previously formed and dried strand into containers, both as single strands and as rovings containing a plurality of strands.

EXAMPLE

Using the apparatus illustrated in the Figure of the accompanying drawing, strand 10 was attenuated at a speed of 8,000 feet per minute (2,438.4 meters per minute). The strand 10 was impinged upon a fine mesh wire screen 34 located at an angle of 45° with respect to the axis of the strand which was rotated at 5,333.3 revolutions per minute. Swirled or coiled glass strand was formed 2.0 inches (5.08 centimeters) below the screen. The swirls or coils had a diameter of 6.0 inches (15.24 centimeters). 300 pounds (136.1 kilograms) of glass strand were collected into a container 38. The resulting packaged strand could be easily removed for further processing.

While the present invention has been described with reference to specific examples thereof, it is not intended to be so limited except insofar as in the accompanying claims.

I claim:

1. In the method of collecting glass fiber strands in a container, the improvement comprising pulling said strands at a high rate of speed in a controlled direction, ejecting said strand into a zone where said strand is impinged on a surface angled from the direction of travel of said strand and rotating said surface around said strand, swirling said strand from said surface to form a plurality of coils of said strand without said strand becoming fluffed by said impingement on said surface and collecting said coils of said strand in a container.

2. The method of claim 1 wherein said surface is a fine mesh screen.

3. The method of claim 2 wherein said surface is angled approximately 30° to 45° from the direction of ejection of said strand.

4. The method of claim 1 wherein said container is larger than the diameter of said coils and is rotating as it collects said coils.

5. The method of claim 1 further comprising attenuating filaments associated with said strand.

6. The method of claim 1 wherein said pulling comprises pulling said strand between a belt and a driven wheel.

7. The method of claim 1 wherein said coils are controlled in diameter by varying the speed of pulling said strand.

8. The method of claim 1 wherein said coils are controlled in diameter by varying the speed of rotating said surface.

9. Apparatus for producing a containerized package of glass strand comprising an attenuator for imparting inertial forces to said strand, a chamber through which said strand passes, means for rotating said chamber and a deflecting surface located within and connected to said chamber for impinging said strand upon without sticking or fluffing of said strand to thereby form said strand into a plurality of coils, and a collector for collecting the resulting coiled strand.

10. The apparatus of claim 9 wherein said deflecting surface comprise a fine mesh screen.

11. The apparatus of claim 10 wherein said surface is angled approximately 30° to 45° from the direction of travel of said strand.

12. The apparatus of claim 9 wherein said attenuator comprises a belt and a driven wheel.

13. The apparatus of claim 9 wherein said collector is larger in diameter than the diameter of said coiled strand and includes means for rotating said collector.

* * * * *